US010395591B2

(12) United States Patent
Kishikawa

(10) Patent No.: US 10,395,591 B2
(45) **Date of Patent: *Aug. 27, 2019**

(54) DISPLAY DEVICE, CMOS OPERATIONAL AMPLIFIER, AND DRIVING METHOD OF DISPLAY DEVICE

(71) Applicant: Saturn Licensing LLC, New York, NY (US)

(72) Inventor: Teisuke Kishikawa, Fukuoka (JP)

(73) Assignee: SATURN LICENSING LLC, New York, NY (US)

( * ) Notice: Subject to any disclaimer, the term of this patent is extended or adjusted under 35 U.S.C. 154(b) by 157 days.

This patent is subject to a terminal disclaimer.

(21) Appl. No.: 15/434,977

(22) Filed: Feb. 16, 2017

(65) Prior Publication Data

US 2017/0162110 A1 Jun. 8, 2017

Related U.S. Application Data

(63) Continuation of application No. 14/212,391, filed on Mar. 14, 2014, now Pat. No. 9,613,584.

(30) Foreign Application Priority Data

Mar. 29, 2013 (JP) ..... 2013-072605

(51) Int. Cl.

| | |
|---|---|
| ***G09G 3/3233*** | (2016.01) |
| ***G09G 3/3275*** | (2016.01) |
| ***G09G 3/36*** | (2006.01) |

(52) U.S. Cl.

CPC ..... *G09G 3/3233* (2013.01); *G09G 3/3275* (2013.01); *G09G 3/3685* (2013.01); *G09G 3/3648* (2013.01); *G09G 2300/0408* (2013.01); *G09G 2300/0819* (2013.01); *G09G 2310/027* (2013.01); *G09G 2310/0291* (2013.01); *G09G 2310/08* (2013.01); *G09G 2320/0252* (2013.01); *G09G 2330/023* (2013.01)

(58) Field of Classification Search

USPC ..... 345/211

See application file for complete search history.

(56) References Cited

U.S. PATENT DOCUMENTS

| | | | | |
|---|---|---|---|---|
| 6,331,846 | B1 * | 12/2001 | Nakao | G09G 3/3614 330/252 |
| 6,332,661 | B1 * | 12/2001 | Yamaguchi | G09G 3/3216 326/82 |
| 8,854,353 | B2 * | 10/2014 | Chung | G09G 3/3266 345/204 |
| 2005/0024351 | A1 | 2/2005 | Sano | |

(Continued)

FOREIGN PATENT DOCUMENTS

| | | |
|---|---|---|
| CN | 1471068 A | 1/2004 |
| CN | 1655224 A | 8/2005 |
| JP | 11-085113 | 3/1999 |

*Primary Examiner* — Jason C Olson
(74) *Attorney, Agent, or Firm* — Dentons US LLP

(57) ABSTRACT

A display device including a display unit which has a plurality of pixels and a plurality of driving lines for driving the plurality of pixels; a driving circuit which drives the plurality of pixels through the plurality of driving lines; and a control unit which adjusts a driving capability of the driving circuit according to the number of simultaneous driving lines of the driving circuit.

9 Claims, 5 Drawing Sheets

(56) References Cited

U.S. PATENT DOCUMENTS

| | | | | |
|---|---|---|---|---|
| 2005/0104819 | A1* | 5/2005 | Shimoda ..... | G09G 3/3283<br>345/76 |
| 2008/0180462 | A1 | 7/2008 | Nose | |
| 2010/0171731 | A1 | 7/2010 | Tanaka | |
| 2012/0105423 | A1 | 5/2012 | Chung | |
| 2014/0009459 | A1 | 1/2014 | Nakata et al. | |
| 2014/0198087 | A1 | 7/2014 | Knausz et al. | |

* cited by examiner

DISPLAY DEVICE, CMOS OPERATIONAL AMPLIFIER, AND DRIVING METHOD OF DISPLAY DEVICE

CROSS REFERENCE TO RELATED APPLICATIONS

This application is a continuation of U.S. patent application Ser. No. 14/212,391 filed Mar. 14, 2014, the entirety of which is incorporated herein by reference to the extent permitted by law. This application claims the benefit of Japanese Priority Patent Application JP 2013-072605 filed Mar. 29, 2013, the entire contents of which are incorporated herein by reference.

BACKGROUND

The present disclosure relates to a display device, a CMOS operational amplifier, and a driving method of the display device.

In general, in a display device such as a liquid crystal display device and an Electro-Luminescence (EL) display device, which performs a display using a plurality of pixels (liquid crystal or EL elements) which are arranged in a matrix shape, the pixels are driven as a load using an amplifier installed in an output stage of a source driver. A driving capability of such an amplifier is constant if the amplifier is a class A amplifier, and varies within a certain constant range according to the load if the amplifier is a class AB amplifier.

Here, there is a case where variation occurs in the load which is driven by the amplifier, due to an influence of a large size or the like of the liquid crystal. In a case where the amplifier is class A, if the load is larger than the driving capability of the amplifier, a problem occurs in which ringing occurs in an output of the amplifier, and if the load is smaller than the driving capability of the amplifier, a problem occurs in which the output of the amplifier is overshot. A technology to solve such problems is disclosed in Japanese Unexamined Patent Application Publication No. 11-85113.

In Japanese Unexamined Patent Application Publication No. 11-85113, an amplifier is disclosed which includes a bias variable circuit that varies a bias current flowing in a differential amplifier and an output circuit. The bias variable circuit can adjust the bias current of the differential amplifier or the bias current of an output unit of the output circuit.

As a result, regardless of a size of the load of the liquid crystal, by increasing the bias current of the output circuit, it is possible to immediately reach a target voltage. At this time, although the ringing or the overshoot occurs in an output waveform, it is possible to immediately reach the target voltage, and thus, a liquid crystal display can be normally performed.

SUMMARY

In an organic EL display device or a liquid crystal display device, there is a case where simultaneous driving of a plurality of lines is necessary, and depending on the number of simultaneous driving lines, a size of a load which is driven by each amplifier can be varied greatly such that the variation is hardly included in a variation width of a driving capability of a class AB amplifier.

For this reason, when the driving capability is insufficient for the loads of the number of simultaneous driving lines, ringing occurs in an output due to insufficient damping, and when the driving capability exceeds the loads of the number of simultaneous driving lines, a response time for reaching a necessary output increases due to excessive damping. Thus, a normal current in an amplifier designed for driving of N lines is increased.

Here, an operational amplifier disclosed in Japanese Unexamined Patent Application Publication No. 11-85113 is a class A amplifier, not a class AB amplifier in which an output current varies according to the load, and vulnerable to an instant pull-in current. For this reason, a peak current of the instant pull-in current is constantly necessary, and a large amount of power is continually consumed. Thus, it is difficult to say that a technology disclosed in Japanese Unexamined Patent Application Publication No. 11-85113 is a technology that sufficiently copes with load variation caused by variation of the number of driving lines.

It is desirable to provide a display device, a CMOS operational amplifier, and a driving method of the display device which suppress an increase of ringing or a response time at the time of load variation, and do not increase power consumption.

According to an embodiment of the present disclosure, here is provided a display device including: a display unit which includes a plurality of pixels and a plurality of driving lines for driving the plurality of pixels; a driving circuit which drives the plurality of pixels through the plurality of driving lines; and a control unit which adjusts a driving capability of the driving circuit according to the number of simultaneous driving lines of the driving circuit.

According to another embodiment of the present disclosure, here is provided a CMOS operational amplifier including: an output stage of a push-pull type output circuit which is configured by a source current output transistor supplying a current to an output terminal, and a sink current output transistor pulling a current from the output terminal; and an adjustment circuit which adjusts size corresponding values of the source current output transistor and the sink current output transistor.

The display device or the CMOS operational amplifier includes various forms which are realized in a state where the display device or the CMOS operational amplifier is integrated with other apparatus, realized by other method, or the like. In addition, the present disclosure can also be realized by a display system which includes the display device, a control method of a display device which has a process corresponding to a configuration of the display device, a program which causes a computer to perform a function corresponding to the configuration of the display device, a computer readable recording medium in which the program is recorded, or the like.

According to the present disclosure, in a display device or a CMOS operational amplifier, it is possible to suppress an increase of ringing or a response time at the time of load variation, and to prevent power consumption from increasing. In addition, the advantage described in the present specification is not limited to the exemplary illustrations, and there may be an additional advantage.

DETAILED DESCRIPTION OF EMBODIMENTS

Hereinafter, the present disclosure will be described in the following order.

(1) First Embodiment
(2) Second Embodiment
(3) Conclusion

(1) FIRST EMBODIMENT

An operational amplifier as a CMOS operational amplifier according to the present embodiment includes an output stage of a push-pull type output circuit which is configured by a source current output transistor supplying a current to an output terminal, and a sink current output transistor pulling a current from the output terminal.

Hereinafter, there is a case where the source current output transistor and the sink current output transistor are collectively referred to as an "output transistor".

The output transistor according to the present embodiment includes a plurality of transistor elements, and is configured by a combination of one or more transistor elements selected from among the plurality of transistor elements.

Here, when all of the output transistors are regarded as one virtual transistor element (hereinafter, referred to as a "virtual transistor element"), a size (channel width W/channel length L) of the virtual transistor element is referred to as a "size corresponding value", and a channel width of the virtual transistor element is referred to as a "channel width corresponding value".

The size corresponding value or the channel width corresponding value can be adjusted by changing in various ways the number of transistor elements or a connection form of the transistor elements which configure the output transistor, using a switching circuit for switching the number of transistor elements or the connection forms of the transistor elements which configure the output transistor. An adjustment subject of the size corresponding value or the channel width corresponding value may be installed inside the operational amplifier or outside the operational amplifier.

If the size corresponding value or the channel width corresponding value is changed, the same result as that obtained by changing the size or the channel width of the virtual transistor element is obtained. That is, if the size corresponding value or the channel width corresponding value of the output transistor is adjusted, an amount of current flowing through the output transistor is adjusted, and furthermore, a load driving capability of the operational amplifier is adjusted.

Figure 1:
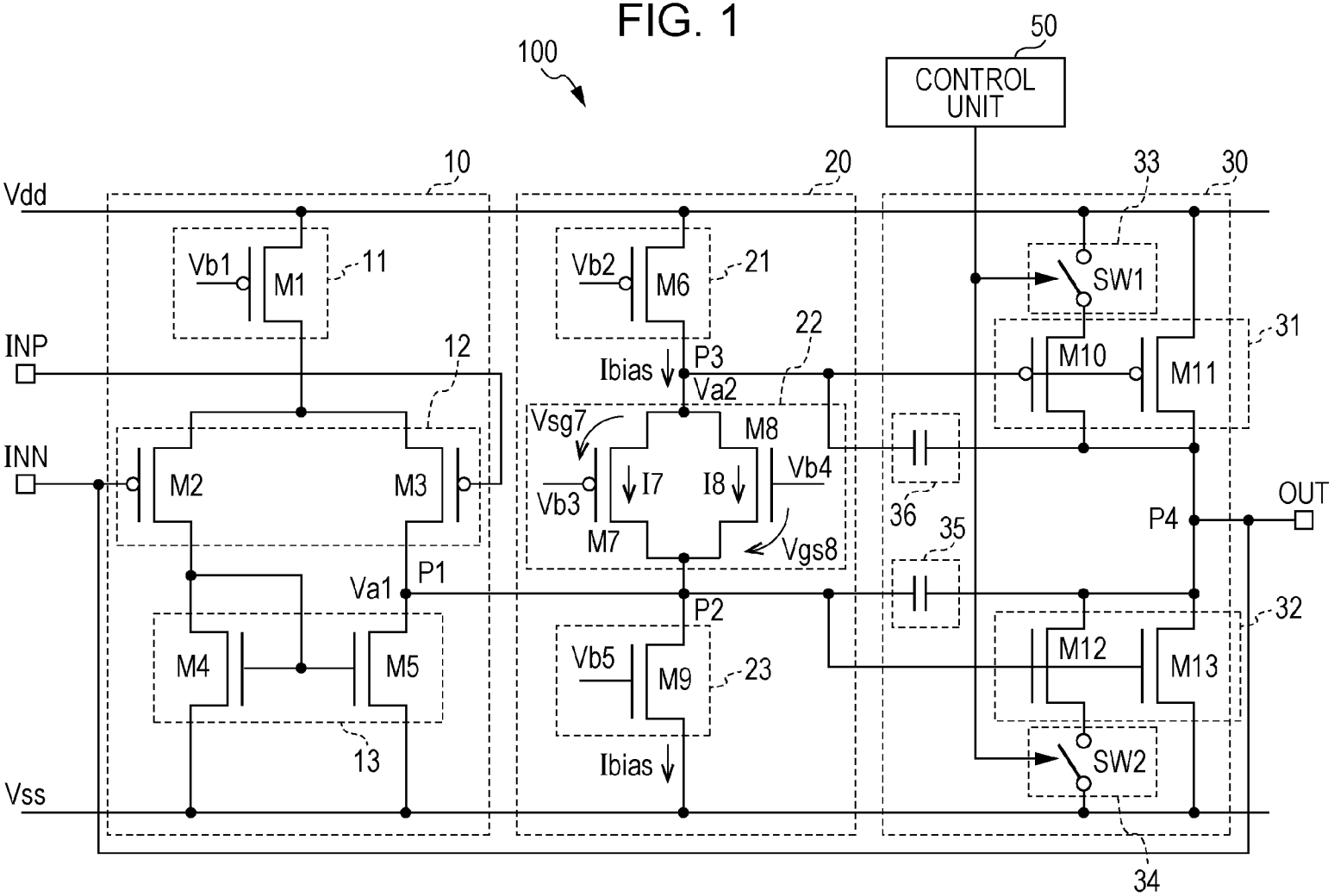
FIG. 1 is a circuit diagram illustrating a specific example of an operational amplifier according to a first embodiment.

Hereinafter, the operational amplifier as the CMOS operational amplifier according to the present embodiment will be specifically described with reference to FIG. 1. FIG. 1 is a circuit diagram illustrating a specific example of the operational amplifier according to a first embodiment.

The operational amplifier 100 illustrated in FIG. 1 includes a differential amplification circuit 10, a bias circuit 20, and an output circuit 30.

The differential amplification circuit 10 includes a PMOS transistor M1 which configures a current source 11, PMOS transistors M2 and M3 which configure a differential pair 12, and NMOS transistors M4 and M5 which configure a current mirror 13.

When the operational amplifier 100 is used, a bias voltage Vb1 is input to a gate of the PMOS transistor M1. As a result, the PMOS transistor M1 generates a current according to the bias voltage Vb1.

A gate of the PMOS transistor M2 which configures the differential pair 12 is connected to an inverting input terminal INN, and a gate of the PMOS transistor M3 is connected to a non-inverting input terminal INP. In the present embodiment, an output of the operational amplifier 100 is negatively fed back to the inverting input terminal INN, and an input signal for being amplified by the operational amplifier 100 is input to the non-inverting input terminal INP.

Gates of the NMOS transistors M4 and M5 which configure the current mirror 13 are connected to each other, and a drain and the gate of the NMOS transistor M4 are connected to each other, and thereby the NMOS transistor M4 functions as a diode. As a result, currents according to a size ratio between the NMOS transistors M4 and M5 flow through the NMOS transistors M4 and M5.

In the differential amplification circuit 10 configured as described above, a voltage Va1 which is proportional to a difference between the voltage of the inverting input terminal INN and the voltage input to the non-inverting input terminal INP is generated at a point P1. A voltage of the point P1 is output to the output circuit 30 as an output voltage of the differential amplification circuit 10.

The configuration of the differential amplification circuit 10 is not limited to the configuration illustrated in FIG. 1. For example, in FIG. 1, the differential pair 12 using the PMOS transistors, the current mirror 13 using the NMOS transistors, and the current source 11 using the PMOS transistor are respectively illustrated, but the differential pair 12 may be configured using NMOS transistors, the current mirror 13 may be configured using PMOS transistors, and the current source 11 may be configured using an NMOS transistor.

The bias circuit 20 includes a PMOS transistor M6 which configures a current source 21, a PMOS transistor M7 and an NMOS transistor M8 which configure a switch circuit 22, and an NMOS transistor M9 which configures a current source 23. In the present embodiment, the switch circuit 22 is configured by a complementary switch circuit in which the PMOS transistor M7 and the NMOS transistor M8 are arranged so as to face each other.

When the operational amplifier 100 is used, a bias voltage Vb2 is input to a gate of the PMOS transistor M6, a bias voltage Vb3 is input to a gate of the PMOS transistor M7, a bias voltage Vb4 is input to a gate of the NMOS transistor M8, and a bias voltage Vb5 is input to a gate of the NMOS transistor M9.

The bias voltages Vb2 and Vb5 are determined such that a bias current Ibias flows through the PMOS transistor M6 and the NMOS transistor M9, the bias voltages Vb3 and Vb4 are determined such that a sum of a current I7 flowing through the PMOS transistor M7 and a current I8 flowing through the NMOS transistor M8 may be the same as the bias current Ibias.

A point P2 between the switch circuit 22 and the current source 23 is connected to the point P1 of the differential amplification circuit 10, and the voltage Va1 of the differential amplification circuit 10 is input to the point P2.

If the voltage Va1 decreases, a gate-source voltage Vgs8 of the NMOS transistor M8 increases, and a current I8 flowing through NMOS transistor M8 increases. At this time, I7=Ibias−I8, and thereby the current I7 flowing through the PMOS transistor M7 decreases. As a result, a source-gate voltage Vsg7 of the PMOS transistor M7 decreases, and a voltage Va2 of a point P3 between the current source 21 and the switch circuit 22 decreases.

On the other hand, if the voltage Va1 increases, the gate-source voltage Vgs8 of the NMOS transistor M8 decreases, and a current I8 flowing through the NMOS transistor M8 decreases. At this time, I7=Ibias−I8, and thereby the current I7 flowing through the PMOS transistor M7 increases. As a result, the source-gate voltage Vsg7 of the PMOS transistor M7 increases, and the voltage Va2 of the point P3 increases.

The output circuit 30 includes PMOS transistors M10 and M11 which configure the source current output transistor 31, NMOS transistors M12 and M13 which configure the sink current output transistor 32, adjustment circuits 33 and 34 and phase compensation capacitors 35 and 36.

The source current output transistor 31 and the sink current output transistor 32 configure a push-pull type output circuit which connects in series a power supply voltage Vdd and a ground voltage Vss. A point P4 which is a connection point of such output transistors is connected to the output terminal OUT. The source current output transistor 31 supplies the current to the output terminal OUT, and the sink current output transistor 32 pulls the current from the output terminal OUT.

Gates as control terminals of the PMOS transistors M10 and M11 which configure the source current output transistor 31 are connected to the point P3 of the bias circuit 20. Gates as control terminals of the NMOS transistors M12 and M13 which configure the sink current output transistor 32 are connected to the point P1 of the differential amplification circuit 10 and the point P2 of the bias circuit 20. As a result, the output circuit 30 outputs a voltage in which the voltage Va1 input from the differential amplification circuit 10 is amplified in a class AB, to the output terminal OUT.

The adjustment circuit 33 is a circuit for adjusting the size corresponding value or the channel width corresponding value of the source current output transistor 31, and the adjustment circuit 34 is a circuit for adjusting the size corresponding value or the channel width corresponding value of the sink current output transistor 32.

In the circuit illustrated in FIG. 1, the adjustment circuit 33 is realized as a switch SW1 which is installed between the PMOS transistor M10 and the power supply voltage Vdd, the adjustment circuit 34 is realized as a switch SW2 which is installed between the NMOS transistor M12 and the ground voltage Vss. ON and OFF of the switches SW1 and SW2 are controlled by a control unit 50. The control unit 50 may be installed inside the operational amplifier 100 or outside the operational amplifier 100.

If the switch SW1 is controlled to be in an OFF state, only the PMOS transistor M11 in the source current output transistor 31 connects the power supply voltage Vdd to the point P4, and if the switch SW1 is controlled to be in an ON state, the PMOS transistors M10 and M11 in the source current output transistor 31 are connected in parallel to each other and connect the power supply voltage Vdd to the point P4.

Here, if the size of the PMOS transistor M10 is set as W10/L10 and the size of the PMOS transistor M11 is set as W11/L11, the size corresponding value of the source current output transistor 31 occurring when the switch SW1 is controlled to be in the OFF state is denoted by W11/L11, and the size corresponding value of the source current output transistor 31 occurring when the switch SW1 is controlled to be in the ON state is denoted by ((W10/L10)+(W11/L11)).

In addition, the channel width corresponding value of the source current output transistor 31 occurring when the switch SW1 is controlled to be in the OFF state is denoted by W11, and the channel width corresponding value of the source current output transistor 31 occurring when the switch SW1 is controlled to be in the ON state is denoted by (W10+W11).

That is, according to an ON and OFF control of the switch SW1, the size corresponding value or the channel width corresponding value of the source current output transistor 31 is adjusted, and as a result, a current supply capability of the source current output transistor 31 to the output terminal OUT, that is, the load driving capability of the operational amplifier 100 is adjusted.

Similarly, if the switch SW2 is controlled to be in the OFF state, only the NMOS transistor M13 in the sink current output transistor 32 connects the point P4 to the ground voltage Vss, and if the switch SW2 is controlled to be in the ON state, the NMOS transistors M12 and M13 in the sink current output transistor 32 are connected in parallel to each other and connect the point P4 to the ground voltage Vss.

Here, if the size of the NMOS transistor M12 is set as W12/L12 and the size of the NMOS transistor M13 is set as W13/L13, the size corresponding value of the sink current output transistor 32 occurring when the switch SW2 is controlled to be in the OFF state is denoted by W13/L13, and the size corresponding value of the sink current output transistor 32 occurring when the switch SW2 is controlled to be in the ON state is denoted by ((W12/L12)+(W13/L13)).

In addition, the channel width corresponding value of the sink current output transistor 32 occurring when the switch SW2 is controlled to be in the OFF state is denoted by W13, and the channel width corresponding value of the sink current output transistor 32 occurring when the switch SW2 is controlled to be in the ON state is denoted by (W12+W13).

That is, according to an ON and OFF control of the switch SW2, the size corresponding value or the channel width corresponding value of the sink current output transistor 32 is adjusted, and as a result, a current pulling capability of the sink current output transistor 32 from the output terminal OUT, that is, the load driving capability of the operational amplifier 100 is adjusted.

Even in the operational amplifier described in the above-described Japanese Unexamined Patent Application Publication No. 11-85113, a current flowing through a sink current output transistor is configured so as to be adjustable, but the current is adjusted in conjunction with a current flowing through a current source which configures a differential amplification circuit. In contrast, in the operational amplifier 100 according to the present embodiment, the current flowing through the current source 11 of the differential amplification circuit 10 is constant, and the adjustment of the size corresponding value of the output transistor and the change of the amount of current flowing in the differential amplification circuit 10 are not consistent with each other.

The phase compensation capacitor 35 connects the point P1 of the differential amplification circuit 10 to the output terminal OUT, and the phase compensation capacitor 36 connects the point P3 of the bias circuit 20 to the output terminal OUT. Such phase compensation capacitors 35 and 36 move a plurality of poles (first pole and second pole) of frequency characteristics of voltage gain of the operational amplifier 100 to a low frequency side.

Since the operational amplifier 100 has an open-loop to which a negative feedback is applied, if input and output phases are reversed, an oscillation is generated even by a small amount of feedback. Then, the phase compensation capacitors 35 and 36 with appropriate values are installed so as to avoid the reverse of the input and output phases. As a result, it is possible to suppress an occurrence of transient ringing caused by a plurality of poles being too close, and transient overdamping caused by the plurality of poles being too far, and to maintain a state of critical damping.

When a sum of a transconductance gm31 (not illustrated) of the source current output transistor 31 and a transconductance gm32 (not illustrated) of the sink current output transistor 32 is set as gm, and total capacitances of the load connected to the output terminal OUT are set as C, the size corresponding values or the channel width corresponding values of the source current output transistor 31 and the sink current output transistor 32 are selected in such a manner that gm/C may be not changed before and after the adjustment.

In addition, in the source current output transistor 31 and the sink current output transistor 32 of the above-described operational amplifier 100, the PMOS transistor M11 and the NMOS transistor M13 are typically connected to each other, and the connection of the PMOS transistor M10 or the connection of the NMOS transistor M12 is configured so as to be switchable by adjustment circuit 33 or 34, but the configuration of the source current output transistor 31 or the configuration of the sink current output transistor 32 is not limited thereto.

Figure 2:
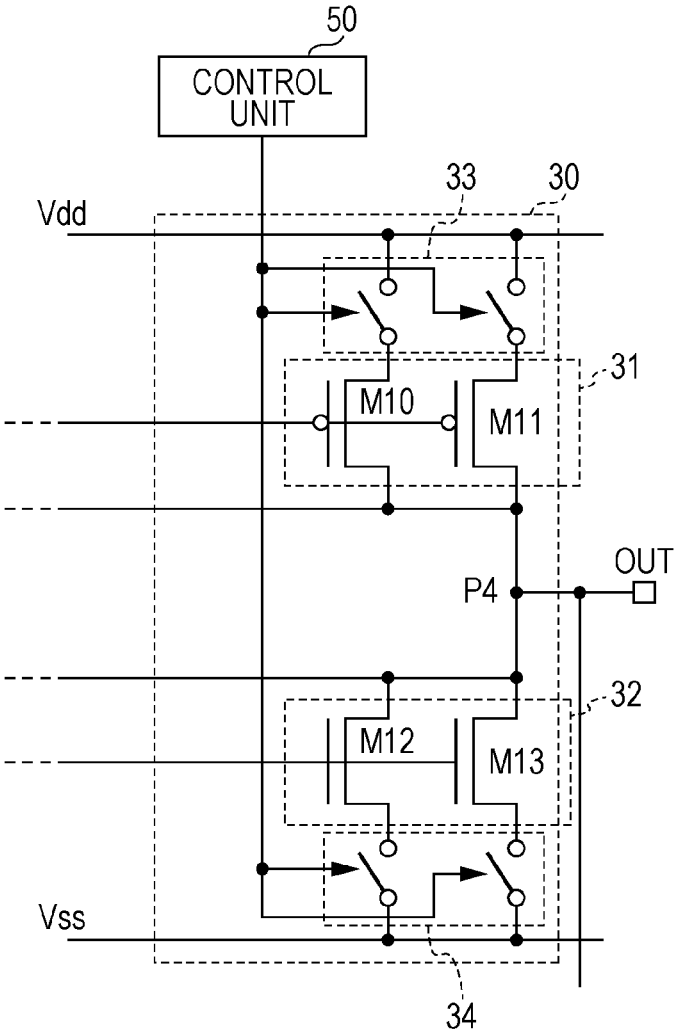
FIG. 2 is a diagram illustrating a modification example of an adjustment circuit of an output transistor.

FIG. 2 is a diagram illustrating another example of the output circuit. In FIG. 2, a switch is installed for each MOS transistor which configures each output transistor. At this time, the source current output transistor 31 can be realized by switching three states: a state in which the power supply voltage Vdd is connected to the point P4 by the PMOS transistor M10 only, a state in which the power supply voltage Vdd is connected to the point P4 by the PMOS transistor M11 only, and a state in which the power supply voltage Vdd is connected to the point P4 by the PMOS transistors M10 and M11 which are connected in parallel to each other.

In addition, the sink current output transistor 32 can be realized by switching three states: a state in which the point P4 is connected to the ground voltage Vss by the NMOS transistor M12 only, a state in which the point P4 is connected to the ground voltage Vss by the NMOS transistor M13 only, and a state in which the point P4 is connected to the ground voltage Vss by the NMOS transistors M12 and M13 which are connected in parallel to each other.

In addition, the number of MOS transistors which configure each output transistor is not limited to two pieces, and can be set as an arbitrary number equal to or greater than 2. In this case, the switches may be all configured by the MOS transistors, and may be partially configured by the MOS transistors.

(2) SECOND EMBODIMENT

Figure 3:
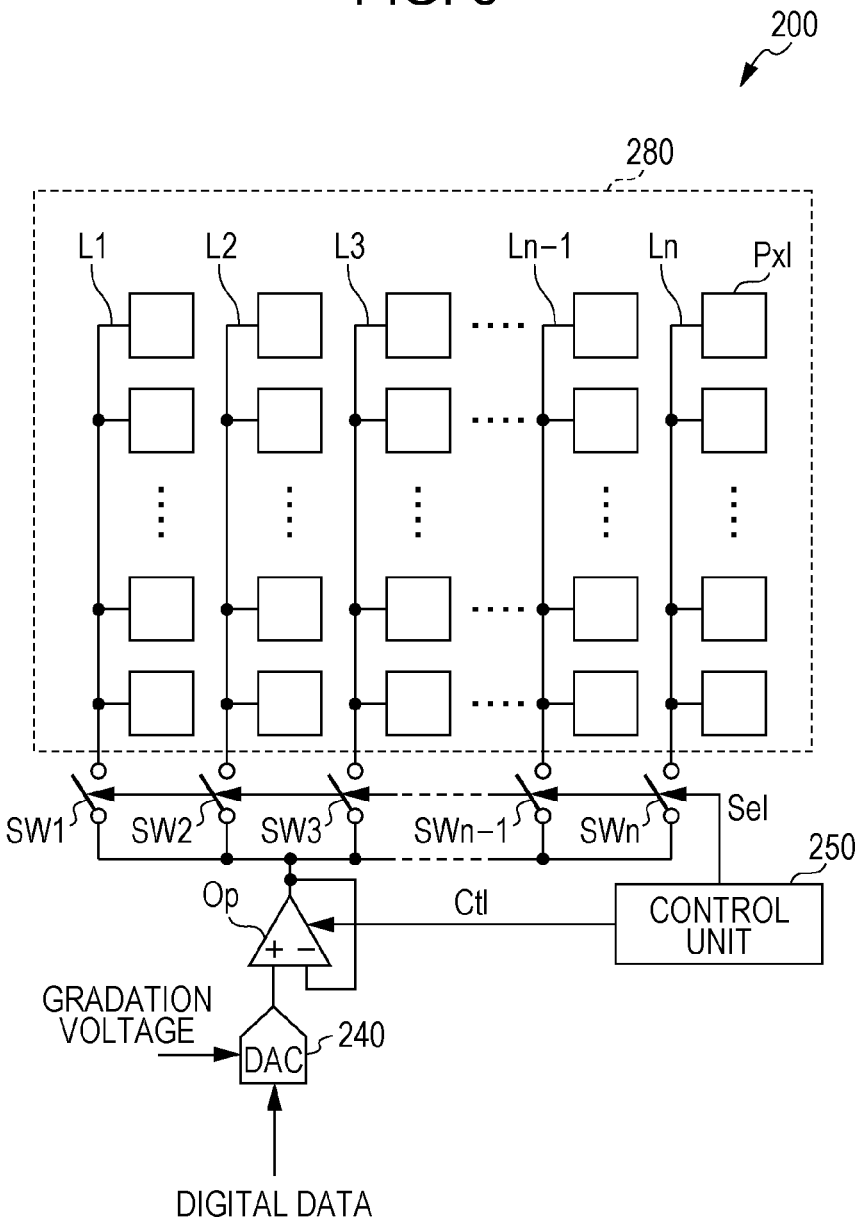
FIG. 3 is a diagram illustrating a configuration of a display device according to a second embodiment.
Figure 4:
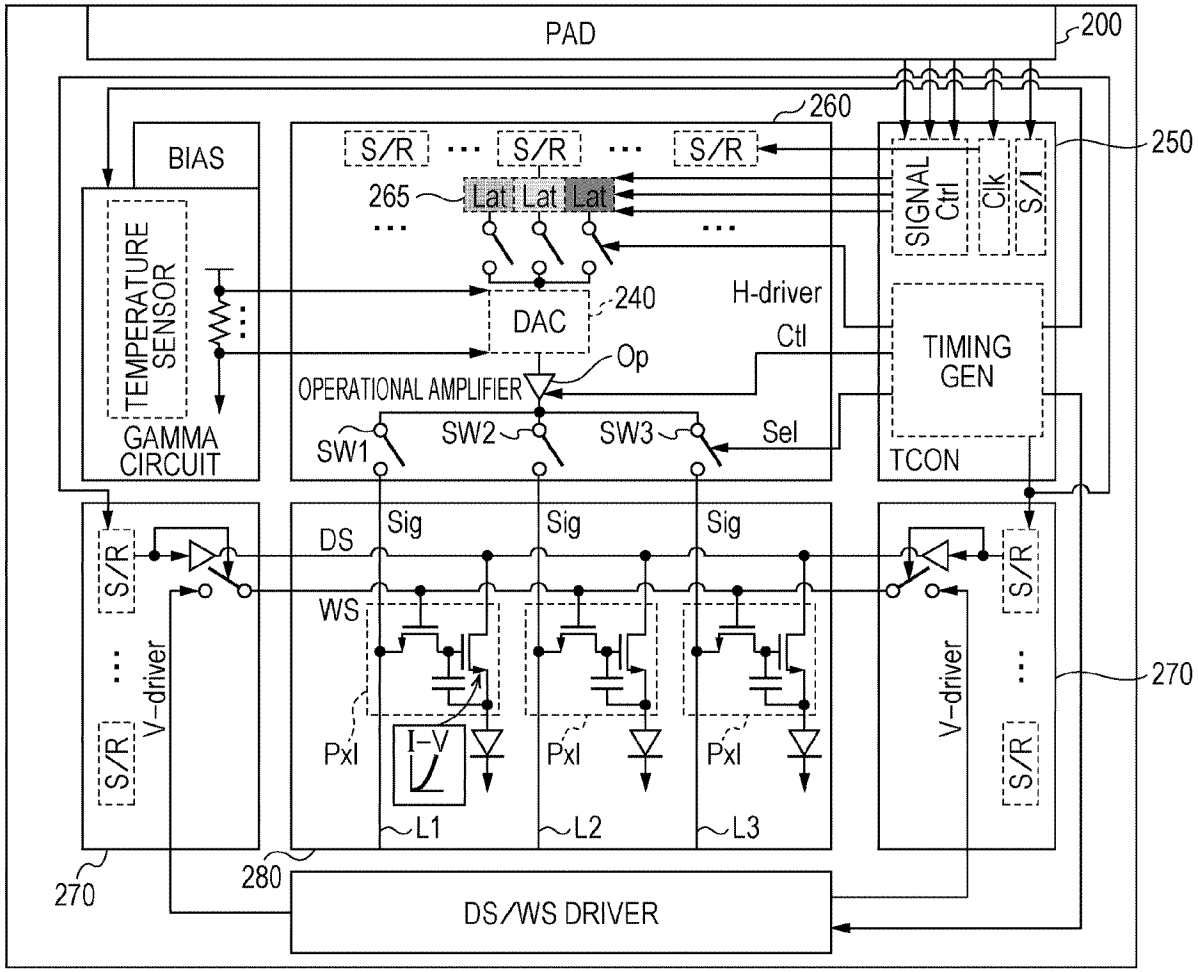
FIG. 4 is a diagram illustrating a configuration of an organic EL display device as an example of a display device.

FIG. 3 is a diagram illustrating a configuration of a display device according to a second embodiment, and FIG. 4 is a diagram illustrating a configuration of an organic EL display device as an example of a display device.

The display device 200 illustrated in FIGS. 3 and 4 includes a display unit 280 which has a plurality of pixels Pxl arranged in a matrix shape and driving lines L1, L2, . . . , and Ln (only three driving lines L1, l2, and L3 are illustrated in FIG. 4) installed for each row of the plurality of pixels Pxl, a plurality of switches SW1, SW2, . . . , and SWn (only three switches SW1, SW2, and SW3 are illustrated in FIG. 4) installed in an input side of each driving line, an operational amplifier Op, a digital analog converter (DAC) 240, and a control unit 250.

Various signals such as digital image data or a clock signal are input to the control unit 250. The control unit 250 performs a control which inputs digital image data D to a latch circuit 265 (not illustrated in FIG. 3) included in a horizontal driving circuit 260 (not illustrated in FIG. 3) and stores the digital image data D therein at an appropriate timing, based on the clock signal, and inputs the digital image data D to the DAC 240 by controlling the latch circuit 265 at an appropriate timing.

The DAC 240 converts the digital image data D into an analog voltage signal. Specifically, the DAC 240 receives a plurality of gradation voltages corresponding to a plurality of gradation values and the digital image data D, and inputs the gradation voltage corresponding to the gradation value of the image data D selected from the plurality of gradation voltages to the operational amplifier Op.

The operational amplifier Op functions as an output buffer which amplifies and outputs the gradation voltage input from the DAC 240. The operational amplifier Op is configured so as to vary the size corresponding value or the channel width corresponding value of the output stage in the same manner as the operational amplifier 100 according to the first embodiment described above. For example, the size corresponding value or the channel width corresponding value is adjusted by a control signal Ctl output from the control unit 250.

The switches SW1, SW2, . . . , and SWn function as a selection circuit for selecting a driving line to which the output signal of the operational amplifier Op is to be input. Specifically, the switches SW1, SW2, . . . , and SWn are installed in each of driving lines L1, L2, . . . , and Ln, and performs an ON and OFF switching of a connection of a corresponding driving line to the operational amplifier Op. For example, the switching is performed according to a selection signal Sel output from the control unit 250.

In FIG. 4, a case where a timing controller ICON configures the control unit 250 is exemplarily illustrated, but there is also a case where the timing controller ICON generates the control signal Ctl according to a control of a control subject such as an external microcomputer connected to a PAD, and inputs the generated control signal to the operational amplifier Op. In this case, the control unit 250 configures the direct control subject of the operational amplifier Op, and the external control subject configures an indirect control subject of the operational amplifier Op.

The driving lines L1, L2, . . . , and Ln are connected to each pixel of a corresponding column, and input a signal input from the operational amplifier Op to the pixels of a row selected by a vertical driving circuit 270 (not illustrated in FIG. 3). As a result, the pixel to which the signal is input emits light using the gradation value according to the image data.

Here, with reference to FIG. 5, a relationship between the number of simultaneous driving lines of the operational amplifier Op and the adjustment of the operational amplifier Op, will be described. FIG. 4 illustrates a corresponding relationship between current consumption of the operational amplifier Op, an output waveform of the operational amplifier Op, and a timing chart illustrating selection timing of the switches SW1, SW2, . . . , and SWn.

Figure 5:
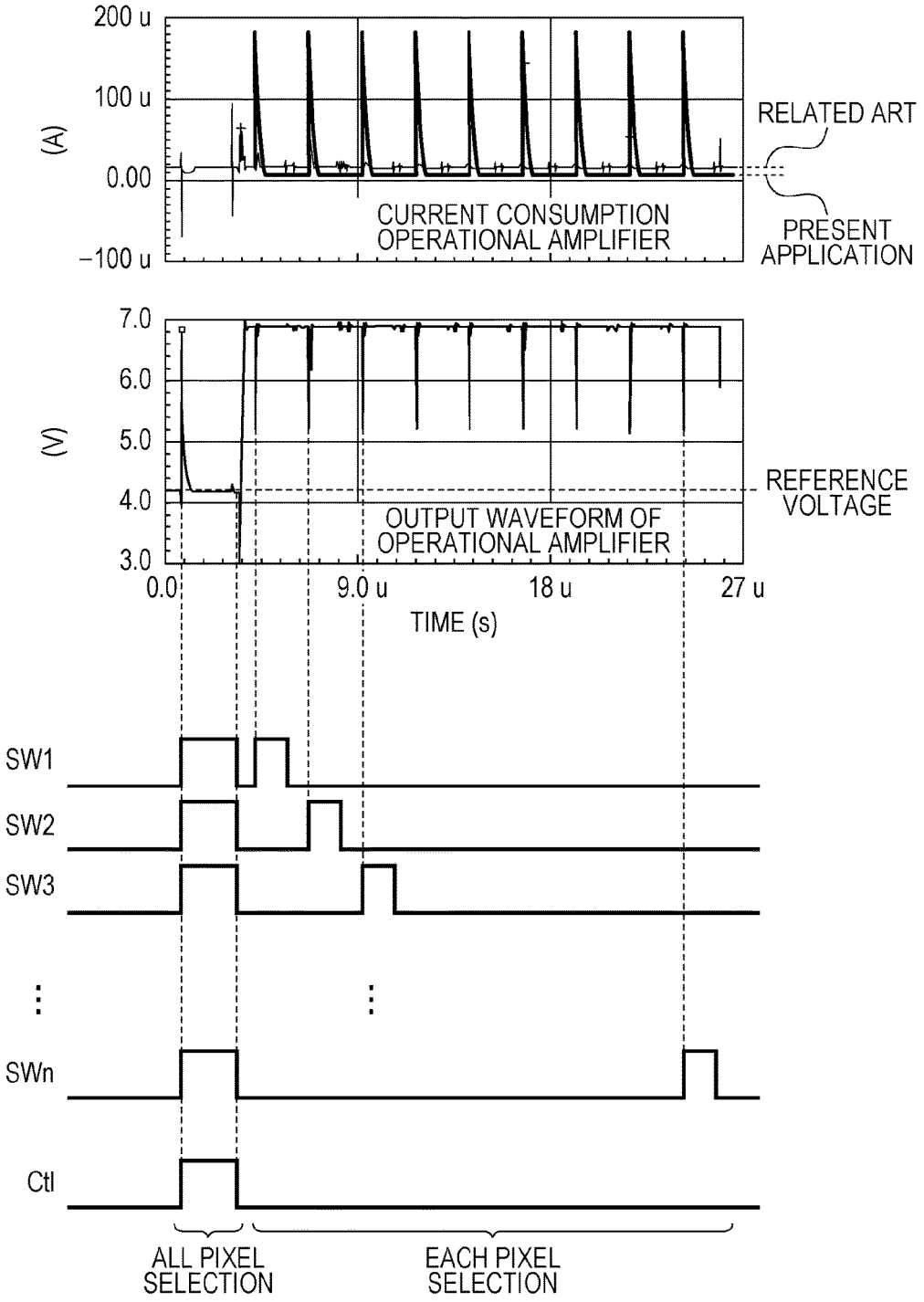
FIG. 5 is a diagram illustrating a corresponding relationship between current consumption of an operational amplifier, an output waveform of the operational amplifier, and a timing chart illustrating selection timing of switches.

In the timing chart illustrated in FIG. 5, all pixel selection in which the selection signal Sel is input to all switches SW1 to SWn is first performed, and thereafter, each pixel selection in which the selection signal Sel is sequentially input to the switches SW1 to SWn is performed. At the time of the all pixel selection, a writing control of a reference voltage with respect to all pixels of a row is performed, and at the time of the each pixel selection, a control which writes a voltage according to the image data to each pixel of the row is sequentially performed.

As illustrated in the current consumption of the operational amplifier, in the related art, the same steady-state current flows even at the time of the all pixel selection and even at the time of the each pixel selection. It is because the operational amplifier in the related art has no function of adjusting the size corresponding value or the channel width corresponding value of the output transistor, and in conjunction with the time of the all pixel selection which asks for larger steady-state current, the size corresponding value or the channel width corresponding value of the output transistor is optimized.

On the other hand, the operational amplifier Op according to the present embodiment, flows the same steady-state current as that in the related art at the time of the all pixel selection, but adjusts the size corresponding value or the channel width corresponding value of the output transistor using the control signal Ctl, and lowers the steady-state current at the time of the each pixel selection compared to that at the time of the all pixel selection. As a result, it is possible to decrease the current consumption compared to the related art.

In addition, the size corresponding value or the channel width corresponding value of the output transistor is adjusted according to an amount of load. In the display device according to the present embodiment, the amount of load is approximately proportional to the number of simultaneous driving lines.

That is, the size corresponding value or the channel width corresponding value of the output transistor at the time of the all pixel selection is adjusted to a value in which an optimal current can be output by simultaneous driving of n driving lines, and the size corresponding value or the channel width corresponding value of the output transistor at the time of the each pixel selection is adjusted to a value in which an optimal current can be output by driving of one driving line. In this way, there is enough load driving capability both at the time of the all pixel selection and at the time of the each pixel selection, and thus, ringing characteristics and response time characteristics are also not deteriorated compared to the related art.

(3) CONCLUSION

The operational amplifier 100 (operational amplifier Op) as the CMOS operational amplifier described above includes, the output stage of the push-pull type output circuit 30 which is configured by the source current output transistor 31 supplying the current to the output terminal OUT and the sink current output transistor 32 pulling the current from the output terminal OUT, and the adjustment circuits 33 and 34 which adjust the size corresponding values of the source current output transistor 31 and the sink current output transistor 32. That is, the size corresponding value or the channel width corresponding value is adjustably designed according to the load of each state, and the size corresponding value or the channel width corresponding value is adjusted, thereby suppressing an increase of the ringing or the response time at the time of load variation and preventing the current consumption from increasing.

In addition, the above-described display device 200 includes, the display unit 280 which has the plurality of pixels Pxl and the plurality of driving lines L1, L2, . . . , and Ln for driving the plurality of pixels Pxl, the horizontal driving circuit 260 which drives the plurality of pixels Pxl through the plurality of driving lines L1, L2, . . . , and Ln, the control unit 250 which adjusts the driving capability of the driving circuit according to the number of simultaneous driving lines of the driving circuit. That is, the driving capability of the driving circuit is adjustably designed according to the load of each state, and the driving capability of the driving circuit is adjusted according to the number of simultaneous driving lines of the driving circuit, and thereby it is possible to suppress an increase of the ringing or the response time at the time of the load variation, and to prevent the current consumption from increasing.

The present disclosure is not limited to the embodiments described above, and includes a configuration in which respective configuration elements disclosed in the above-described embodiments are replaced with each other or a combination thereof is changed, a configuration in which respective configuration elements disclosed in an existing technology and the above-described embodiments are replaced with each other or a combination thereof is changed, and the like. In addition, a technical scope of the present disclosure is not limited to the above-described embodiments, and includes description of the claims and equivalents thereof.

Then, the present disclosure can include the following configurations.

(A) A display device includes, a display unit which includes a plurality of pixels and a plurality of driving lines for driving the plurality of pixels; a driving circuit which drives the plurality of pixels through the plurality of driving lines; and a control unit which adjusts a driving capability of the driving circuit according to the number of simultaneous driving lines of the driving circuit.

(B) The display device according to (A) in which the control circuit adjusts the driving circuit in such a manner that the driving capability is approximately proportional to the number of simultaneous driving lines.

(C) The display device according to (A) or (B) in which the driving circuit includes a CMOS operational amplification circuit, in which the CMOS operational amplification circuit includes an output stage of a push-pull type output circuit which is configured by a source current output transistor supplying a current to an output terminal, and a sink current output transistor pulling a current from the output terminal, and in which the control unit adjusts the driving capability of the driving circuit by adjusting size corresponding values of the source current output transistor and the sink current output transistor.

(D) The display device according to (C) in which a ratio between a sum of a transconductance of the source current output transistor and a transconductance of the sink current output transistor, and a capacitance of a load which is driven by the output circuit, is constant before and after the adjustment of the size corresponding value.

(E) The display device according to (C) or (D) further includes a differential amplification circuit which amplifies and outputs a difference between two inputs, in which the output circuit amplifies the output of the differential amplification circuit and outputs the amplified output to the output terminal, and in which the adjustment of the size corresponding value and a change of an amount of current flowing in the differential amplification circuit are not in conjunction with each other.

(F) The display device according to any one of (C) to (E) in which the output circuit includes a configuration in which the source current output transistor and the sink current output transistor are connected in series to each other between a power supply and a ground, and outputs a voltage of a connection point of the source current output transistor and the sink current output transistor, in which the source current output transistor includes a plurality of transistor elements, and one or more transistor elements selected by an adjustment circuit from among the plurality of transistor elements are connected in parallel between the power supply and the sink current output transistor, and in which the sink current output transistor includes a plurality of transistor elements, and one or more transistor elements selected by the adjustment circuit from among the plurality of transistor elements are connected in parallel between the source current output transistor and the ground.

(G) A CMOS operational amplifier includes, an output stage of a push-pull type output circuit which is configured by a source current output transistor supplying a current to an output terminal, and a sink current output transistor pulling a current from the output terminal; and an adjustment circuit which adjusts size corresponding values of the source current output transistor and the sink current output transistor.

(H) A control method of a display device that includes a display unit which has a plurality of pixels and a plurality of driving lines for driving the plurality of pixels, and a driving circuit which drives the plurality of pixels through the plurality of driving lines, the method includes adjusting a driving capability of the driving circuit according to the number of simultaneous driving lines of the driving circuit.

It should be understood by those skilled in the art that various modifications, combinations, sub-combinations and alterations may occur depending on design requirements and other factors insofar as they are within the scope of the appended claims or the equivalents thereof.

What is claimed is:

1. An organic electro-luminescence display device comprising:

a display unit having a plurality of pixels and a plurality of driving lines for driving the plurality of pixels;

a driving circuit which drives the plurality of pixels through the plurality of driving lines, the driving lines being selectively connectable to an output of the driving circuit; and a control unit which adjusts a driving capability of the driving circuit according to the number of simultaneously driven driving lines of the driving circuit, the driving capability being an amount of power available to drive the pixels.

2. The organic electro-luminescence display device according to claim 1, wherein the control circuit adjusts the driving circuit in such a manner that the driving capability is approximately proportional to the number of simultaneously driven driving lines.

3. An organic electro-luminescence display device comprising:

a display unit having a plurality of pixels and a plurality of driving lines for driving the plurality of pixels;

a driving circuit which drives the plurality of pixels through the plurality of driving lines; and a control unit which adjusts a driving capability of the driving circuit according to the number of simultaneously driven driving lines of the driving circuit, wherein:

the driving circuit includes a CMOS operational amplification circuit, the CMOS operational amplification circuit includes (a) an output stage of a push-pull type output circuit which is configured by a source current output transistor supplying a current to an output terminal, and (b) a sink current output transistor for pulling a current from the output terminal, and the control unit is configured to the driving capability of the driving circuit by adjusting size corresponding values of the source current output transistor and the sink current output transistor.

4. The organic electro-luminescence display device according to claim 3, wherein:

a ratio between (a) a sum of a transconductance of the source current output transistor and a transconductance of the sink current output transistor, and (b) a capacitance of a load which is driven by the output circuit, is constant before and after the adjustment of the size corresponding values.

5. The organic electro-luminescence display device according to claim 3, further comprising a differential amplification circuit which amplifies and outputs a difference between two inputs, wherein:

the output circuit amplifies the output of the differential amplification circuit and outputs the amplified outputs to the output terminal, and the adjustment of the size corresponding values and a change of an amount of current flowing in the differential amplification circuit are not in conjunction with each other.

6. The organic electro-luminescence display device according to claim 3, wherein:

(a) the output circuit includes a configuration in which the source current output transistor and the sink current output transistor are connected in series to each other between a power supply and a ground, and outputs a voltage of a connection point of the source current output transistor and the sink current output transistor;

(b) the source current output transistor includes a plurality of transistor elements;

(c) two or more of the plurality of transistor elements selected by an adjustment circuit are connected in parallel between the power supply and the sink current output transistor; and (d) the sink current output transistor includes a plurality of transistor elements.

7. An organic electro-luminescence display device comprising:

a display unit having a plurality of pixels and a plurality of driving lines for driving the plurality of pixels;

a control circuit; and a driving circuit controlled by the control circuit for driving the plurality of driving lines, wherein the driving circuit includes a CMOS operational amplifier with an output selectively connectable to one or more of the driving lines, any number of which can be simultaneously connected to the output of the CMOS operational amplifier.

8. An organic electro-luminescence display device comprising:

a display unit having a plurality of pixels and a plurality of driving lines for driving the plurality of pixels; and a driving circuit for driving the plurality of driving lines, wherein the driving circuit includes a CMOS operational amplifier, wherein the CMOS operational amplifier comprises:

an output stage of a push-pull type output circuit which is configured by a source current output transistor supplying a current to an output terminal;

a sink current output transistor pulling a current from the output terminal; and an adjustment circuit which adjusts size corresponding values of the source current output transistor and the sink current output transistor.

9. A control method of an organic electro-luminescence display device that includes a display unit which has a plurality of pixels and a plurality of driving lines for driving the plurality of pixels, and a driving circuit which drives the plurality of pixels through the plurality of driving lines, the method comprising: adjusting a driving capability of the driving circuit according to the number of simultaneously driven driving lines of the driving circuit, the driving capability being an amount of power available to drive the pixels.

* * * * *